United States Patent [19]

Faré

[11] Patent Number: 5,074,686

[45] Date of Patent: Dec. 24, 1991

[54] AUTOMATIC GAP ADJUSTMENT APPARATUS FOR PRINTING HEAD

[75] Inventor: Carlo Faré, Limito, Italy

[73] Assignee: Bull HN Information Systems Italia S.p.A., Caluso, Italy

[21] Appl. No.: 490,220

[22] Filed: Mar. 8, 1990

[30] Foreign Application Priority Data

Mar. 15, 1989 [IT] Italy ..... 19786 A/89

[51] Int. Cl.[5] ..... B41J 25/308

[52] U.S. Cl. ..... 400/59; 400/124

[58] Field of Search ..... 400/55-59, 400/124, 157.2, 167

[56] References Cited

U.S. PATENT DOCUMENTS

| | | | |
|---|---|---|---|
| 4,174,908 | 11/1979 | Wehler | 400/56 |
| 4,300,846 | 11/1981 | Rose | 400/124 |
| 4,333,398 | 6/1982 | Carson | 400/166 |
| 4,407,193 | 10/1983 | Hall | 400/166 |
| 4,548,066 | 10/1985 | Martinez | 73/1 J |
| 4,676,675 | 6/1987 | Suzuki | 400/59 |
| 4,907,901 | 3/1990 | Mitchell | 400/55 |

FOREIGN PATENT DOCUMENTS

| | | | |
|---|---|---|---|
| 55808 | 4/1983 | Japan | 400/56 |
| 2124386 | 2/1984 | United Kingdom . | |

*Primary Examiner*—David A. Wiecking
*Assistant Examiner*—Steven S. Kelley
*Attorney, Agent, or Firm*—J. S. Solakian; J. H. Phillips

[57] ABSTRACT

Apparatus for automatically adjusting the distance of a printing head from a printing support wherein motor means enable changing, on command, the print head distance from the support and a movable armature/-plunger electromagnetic detector, fixed to the printing head is energized, when the print head is moved far from the printing support, so as to perform the cocking of the armature/plunger and is thereafter maintained in energized status by a minimal current for holding the electromagnet in cocked state, so that a subsequent movement of the print head towards the printing support, owing to the interference with the printing support of an actuation element coupled to the armature/-plunger, causes armature/plunger release and a reluctance change, hence an e.m.f. induced in the energization winding which is detected by a comparator circuit and signaled to a control logic to indicate that the print head is at a predetermined distance from the printing support. If the print head is provided with electromagnetic printing actuators, the detection function may be performed by one or more actuation elements.

2 Claims, 2 Drawing Sheets

AUTOMATIC GAP ADJUSTMENT APPARATUS FOR PRINTING HEAD

BACKGROUND OF THE INVENTION

1. Field of the Invention

The present invention relates to an apparatus for the automatic adjustment of the gap between printing head and platen in a serial impact printer.

2. The Prior Art

It is known that the impact serial printers, generally dot matrix printers, are ubiquitous on the market as computer peripheral units.

Such printers may print on printing media having differing thickness, such as single sheets, multiple-copy media, books.

Depending on the media thickness they need an adjustment of the gap between the printing head and platen where the printing media is positioned. This adjustment can be performed manually by means of suitable adjusting devices or automatically.

Mechanical adjustment devices have long been proposed. An example of such devices may be found in U.S. Pat. No. 3,990,560.

Mechanical devices do not provide the reliability required in modern printers.

Recently impact printers have appeared on the market which are provided with more reliable automatic gap adjustment devices.

In such printers, the printing head is slidably mounted on a guiding shaft parallel to the platen. The shaft is pivoted at its ends within two mounting bushings and can rotate in such bushings. The bushings are fixed on the side plates of the printer frame at a predetermined distance from the platen.

The ends of the shaft, pivoted within the bushings, are eccentric as to the shaft so that by changing the angular position of the shaft its distance from the platen and therefore the distance of the printing head from the platen is changed. The shaft is rotated by a motor (generally a step motor) controlled by logic circuits.

A conductive rubber pad, whose resistance depends on the pressure exerted on it, is used as position detector. The rubber pad is mounted on the printing head, close to the printing elements. When the print head is correctly positioned as to the printing media and the platen, the pad is in contact with the media, slightly compressed by the media, and provides a corresponding current/voltage electrical signal when suitably powered by a voltage/current generator.

This signal, whose amplitude depends on the contact pressure, controls, through suitable circuits, the motor which rotates the shaft, so as to impose a distance of the printing head from the media such that the signal generated by the position detector has a predetermined amplitude, corresponding to a correct positioning.

Although the detector element is particularly simple and inexpensive, it requires amplifying circuits, temperature compensation circuits and trimmers which are rather expensive.

Moreover, the electrical characteristics of the detector are subject to drift over time, owing to aging of the material and temperature changes.

Therefore, the resulting apparatus is rather expensive and at long term unreliable, unless frequently trimmed.

These disadvantages are overcome by the apparatus for the automatic adjustment of the gap between a print head and a printing media which is the object of the present invention.

This apparatus is reliable, stable in operation, very simple and inexpensive.

SUMMARY OF THE INVENTION

According to the invention, the apparatus comprises a movable armature or plunger electromagnet as a printing head position detector.

The electromagnet is cocked, that is, actuated, by an energizing pulse, when the print head is kept far from the platen.

It is then kept actuated by a holding current sufficient to exert an attraction force which counterbalances the return action exerted by resilient means on the armature.

Then the print head is advanced towards the printing support until the electromagnet armature interferes with the printing support.

The interference causes the release of the armature.

The reluctance increase in the magnetic circuit, consequent to the release, causes the generation of an e.m.f. induced pulse, hence a change of the voltage at the terminals of the electromagnet winding.

This change is detected by a comparator circuit which generates a stop command for the motor means which drive the print head towards the platen. In this way the print head is correctly positioned as to the printing support.

According to a further aspect of the invention, the print head positioning is performed using as a position detector one or more of the printing elements normally provided in an impact print head for performing the printing operation. These printing elements are generally actuated by electromagnets.

The features and the advantages of the invention will appear more clearly from the following description of the preferred form of embodiment and some variants of the same, and from the enclosed drawings where:

THE PREFERRED EMBODIMENT

Figure 1:
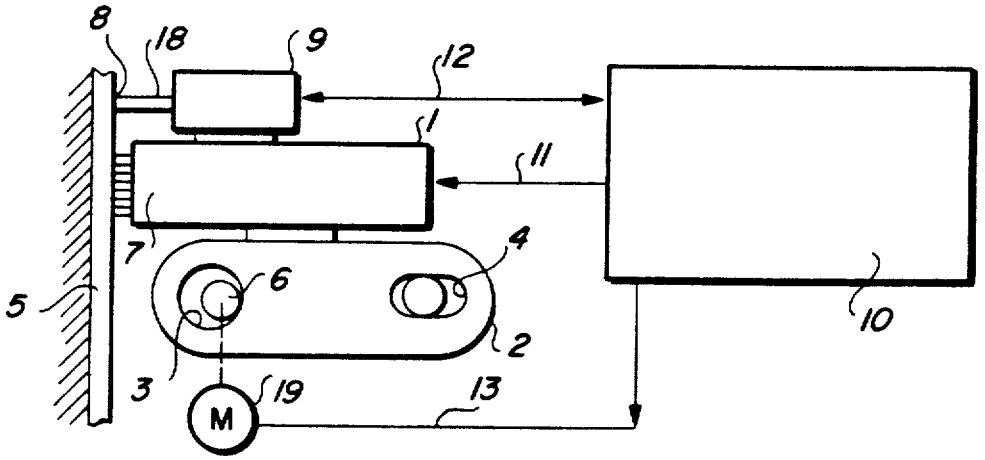
FIG. 1 is a block diagram of a preferred embodiment of the invention apparatus.

FIG. 1 schematically shows in side view a printing head 1 mounted on a carriage 2 slidable on guiding shafts 3, 4 disposed parallel to a platen 5. Printing needles 7 protrude from a printing end of the printing head.

Each of the needles is actuated by a related actuator, contained in the printing head 1.

A printing media or printing support 8 and an inking ribbon, not shown, are interposed between the platen and the needles. When the printing needles are actuated, they press the inking ribbon and the printing support against the platen and cause the printing of dots on the media.

The gap between the printing head and the platen must be adjusted depending on the printing media thickness.

To this purpose the guiding shaft 3 is provided with two eccentric pins 6, inserted in bushings (not shown).

A step motor 19, whose shaft is coupled one of the pins, directly or though a reduction coupling, causes the rotation of the guiding shaft 3 and the modification of the carriage and printing head distance from the platen.

A position detector 9, consisting of an electromagnet having a movable armature or plunger, is fixed to the printing head.

For clarity, it is shown in FIG. 1 as mounted above the printing head. Preferably, it is mounted to the side.

An actuation rod 18, actuated by the armature or plunger of the electromagnet, protrudes outside the electromagnet.

When the electromagnet is energized and the print head is correctly positioned as to the printing support, it interferes with the printing support. The interference may be suitably established to be 0.05-0.1 mm.

A printer control logic 10 controls the printing electromagnets through a bus 11 and powers, through a lead pair 12, the detector 9.

It further controls the motor 19 through a bus 13.

The apparatus of the invention substantially operates as follows:

Control logic 10 controls motor 19 so that the printing head 1 is brought far from the platen.

It provides further to energize the electromagnet 9, with a start-up current which assures the armature closing.

Then the electromagnet 9 remains energized by a holding current which prevents the armature release due to resilient biasing means.

Once a printing media has been inserted, manually or automatically, between the print head and the platen, the control logic controls motor 19 so that the printing head is advanced towards the platen.

As soon as the actuation rod 18 of the electromagnet interferes with the printing support, it causes the release of the armature or the plunger.

Under these conditions, the holding current is not sufficient to counteract to the resilient biasing means which act on the armature or the plunger.

Therefore, the armature or plunger is driven in fully open position, with a significant air gap increase, hence a significant change in the reluctance of the magnetic circuit, which is magnetized by the holding current.

The increase in the circuit reluctance causes a reduction in the magnetic flux of the circuit and an induced e.m.f. which appears at the terminals of the electromagnet winding as a voltage change as well as a change in the drain current.

This current change is detected by the control logic 10 which provides to stop motor 19, causing the print head 1 to retain a correct printing position related to the thickness of the printing media.

Figure 2:
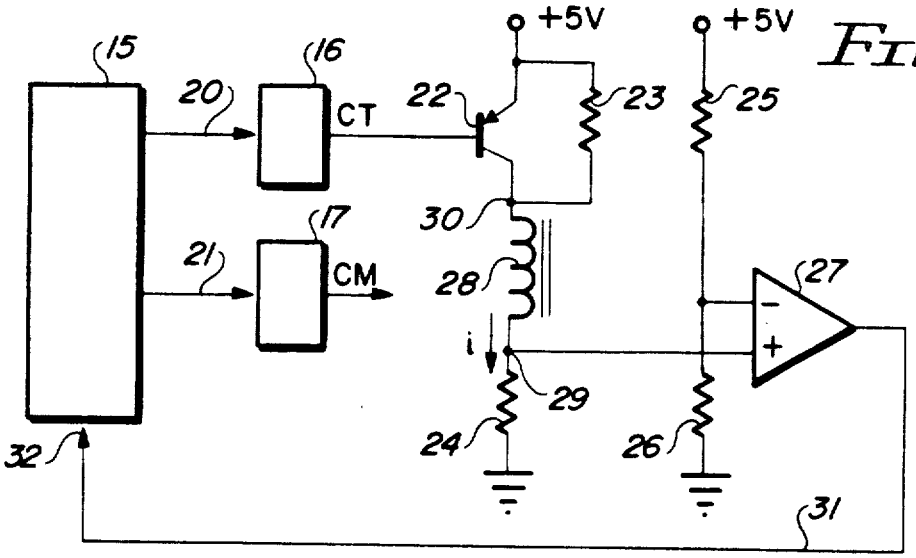
FIG. 2 is a preferred embodiment of detection circuit for the apparatus of FIG. 1.

FIG. 2 shows the circuits for detecting the status of electromagnet 9. These circuits are included in the control logic 10.

Control logic 10 comprises a microprocessor 15 for the control of the whole printer and a plurality of interface registers.

Two of such registers, 16, 17 are shown.

These registers are loaded with suitable control information by microprocessor 15, through channels 20, 21.

The circuits for powering and detecting the status of electromagnet 9 comprise a transistor 22, of PNP type, a current limiting resistor 23, a measuring resistor 24, two biasing resistors 25, 26 and a comparator 27.

Transistor 22 has the emitter connected to a suitable voltage source, for instance +5V, and the collector connected to a terminal 30 of the electromagnet winding 28. The other winding terminal 29 is grounded through the measuring resistor 24.

Resistor 23 directly connects terminal 30 to the voltage source +5V.

Terminal 29 is connected to the non inverting input of comparator 27 which has the inverting input connected to ground, through resistor 26 and to voltage source +5V, through resistor 25. The two resistor 25, 26 form a voltage divider for providing a reference voltage VR to the inverting input. The output of comparator 27 is connected to an interrupt input of microprocessor 15, through lead 31.

One output of register 16 is connected to the base of transistor 22 for applying a control signal CT.

Control signal CM are available at outputs of register 17 for controlling motor 19 of FIG. 1.

Figure 3:
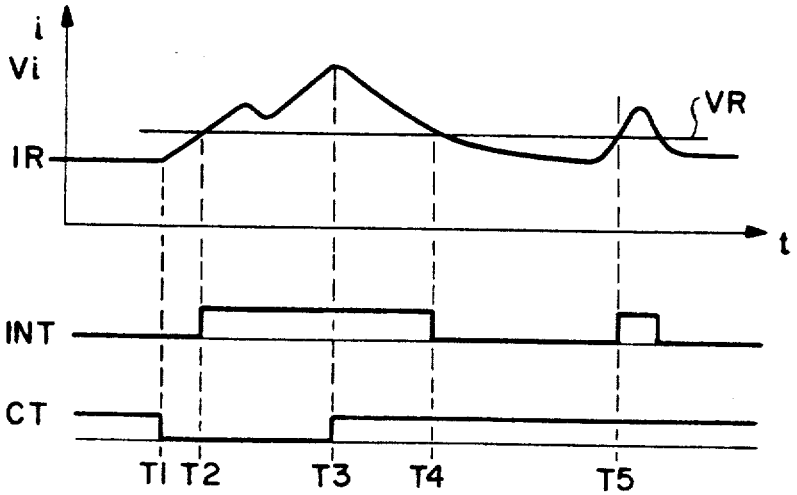
FIG. 3 shows in timing diagram the signal levels at selected points of the circuit of FIG. 2.

Diagram i of FIG. 3 shows, in qualitative form, the dc current flowing in the winding 28, hence the voltage Vi available at terminal 29, owing to the voltage drop in measuring resistor 24.

Diagram INT shows the output signal from comparator 27 related to current changes in winding 28.

Diagram CT shows the control signal applied to the base of transistor 22.

The circuit operation is very simple.

In static rest conditions when CT is at electrical level "high" and transistor 22 is open, a rest current flows in winding 28.

This current is limited by the internal resistance of winding 28 and by resistors 23, 24 series connected with the winding.

When at a time instant T1 microprocessor 15 loads register 20 and signal CT is dropped to electrical level 0, transistor 22 becomes conductive.

Current i increases, according to exponential law, and causes the armature attraction.

Incidentally the armature attraction causes a temporary current drop in the winding.

The current rise in the winding causes a corresponding voltage rise at terminal 29.

At time T2, when the voltage at terminal 29 exceeds the reference voltage VR, the comparator, which was outputting a signal at level 0, raises its output at a positive level, thus asserting an interrupt signal towards the microprocessor.

This interrupt signal is not considered by microprocessor 15, owing to a preceding internal command for interrupt masking.

At time T3 microprocessor 15 loads register 20 with a new set of information and signal CT raises to a positive level. Transistor 22 is open and the current in winding 28 decays according to exponential law, down to the rest level IR, which holds the armature in attracted position.

At time T4 the decreasing current reaches a level such that the voltage at terminal 29 is lower than the reference voltage VR.

Therefore, the interrupt signal INT drops to zero.

Once the armature has been attracted, owing to control signal CT, and a time interval has elapsed sufficing for return of the energization current to the rest value IR, microprocessor 15 is enabled to detect the interrupt signal INT and loads register 21 with suitable control signals (or control signal sequences).

These signals cause the energization of motor 19 so as to gradually bring the print head closer to the platen.

When, at time T5, the actuation rod 18 of the electromagnet interferes with the printing support, owing to the print head movement, the electromagnet armature is released.

The reluctance change in the magnetic circuit, causes an induced e.m.f. which develops a current spike in winding 28 and resistor 24.

Due to such spike, the voltage at winding 29 exceeds the reference voltage VR and comparator 27 generates the interrupt signal INT at positive level.

This signal is detected by microprocessor 15, which, by suitable commands loaded in register 17, causes the blocking of motor 19 and the holding of the printing head at a predetermined distance from the printing support.

The control functions are essentially performed by microprocessor 15, which in order to adjust the position of the print head, has to execute a control routine.

This routine may be summarized in the following steps:

A—Move the print head apart from the platen.
B—Mask interrupt
C—Cock electromagnet (control Signal CT)
D—Feed printing media (if automatic feeding is provided)
E—Move print head carriage in printing zone.
F—Enable interrupt recognition
G—Move print head closer to the platen
H—Interrupt detected
I—Stop print head
J—Start printing program

ALTERNATIVE EMBODIMENTS

It is clear that the circuit of FIG. 2 is only a preferred form of embodiment and that several changes can be made, with different arrangements of the components.

Figure 4:
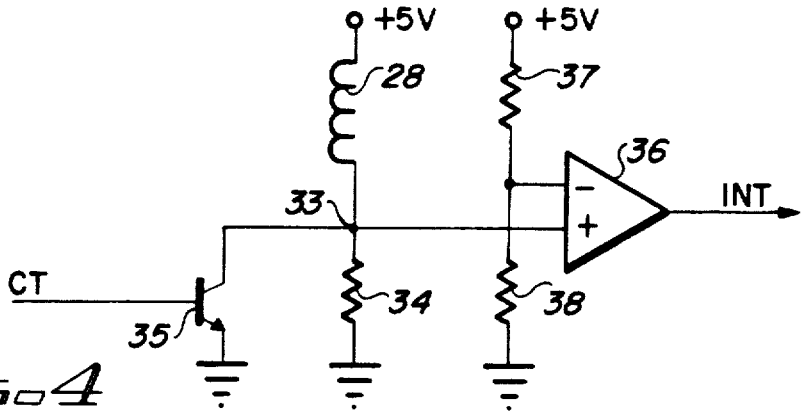
FIG. 4 is an alternative embodiment of detection circuit for the apparatus of FIG. 1.

By way of example, FIG. 4 shows a detection circuit where a single resistor performs both function of current limiting and measurement.

In FIG. 4, a terminal of winding 28 of electromagnet 9 (FIG. 2) is directly connected to a voltage source, for instance +5V.

The other terminal 33 is connected to ground, through a resistor 34. It is further connected to the collector of a transistor 35, having grounded emitter.

The base of transistor 35, of NPN type, receives a control signal CT generated by the controlling microprocessor.

In this case, signal CT has a polarity inverted as to the polarity of signal CT shown in FIGS. 2 and 3.

Terminal 33 is connected to the non inverting input of a comparator 36, which receives a reference voltage VR at the inverting input.

VR is obtained from a voltage divider comprising two resistors 37, 38 series connected between voltage +5V and ground.

In rest conditions, a holding current flows in winding 28. The current is limited by the internal resistance of the winding and by resistor 34, series connected.

The resistance value of such elements establishes the value of voltage V1 at terminal 33.

V1 is lower than the powering voltage +5V.

The reference voltage VR input to the inverting input of comparator 36 is chosen so as to be higher than V1 so that in normal conditions comparator 36 outputs a signal at electrical level 0.

When transistor 35 is closed, terminal 33 drops to an electrical level which is virtually zero and the output of comparator 36 remains at zero level.

The current flowing in the winding 28 increases and causes the actuation of the electromagnet 9, and the cocking of the armature.

When transistor 35 is switched off, an e.m.f. is induced in winding 28 which raises the terminal 33 voltage at a level higher than the reference voltage VR, so that comparator asserts an interrupt signal at its output. As in the case of FIG. 2, this signal is masked and ignored by the controlling microprocessor.

Once the transient is ended, terminal 33 drops again to voltage level V1.

As in the case of FIG. 2, by bringing the print head closer to the printing support, the actuation rod of electromagnet 9 is caused to interfere with the printing support and the armature is released.

The armature release causes a current spike in winding 28 and a voltage spike at terminal 33.

The voltage exceeds the reference voltage VR with the consequences already considered with reference to FIG. 2.

In the two described embodiments the electromagnet 9 is fixed to the printing head in a position such that when the armature is released, the print head is spaced of the required amount from the printing support.

More generally it suffices that the armature release occurs when the print head is at a known predetermined distance from the printing support. This distance may be different and greater or lesser than the one required for correct printing operation.

Once this distance from the printing support has been detected, it is possible to control motor 19 of FIG. 1 so as to move the print head, closer to (or away from) the printing support so as to achieve the required printing position.

This consideration leads to a further embodiment of the apparatus of the invention.

Rather than using a detecting electromagnet as 9 of FIG. 1, in the case of print heads provided with electromagnetic actuators for actuation of the printing elements, it is possible to use one or more of these actuators as position detectors.

Figure 5:
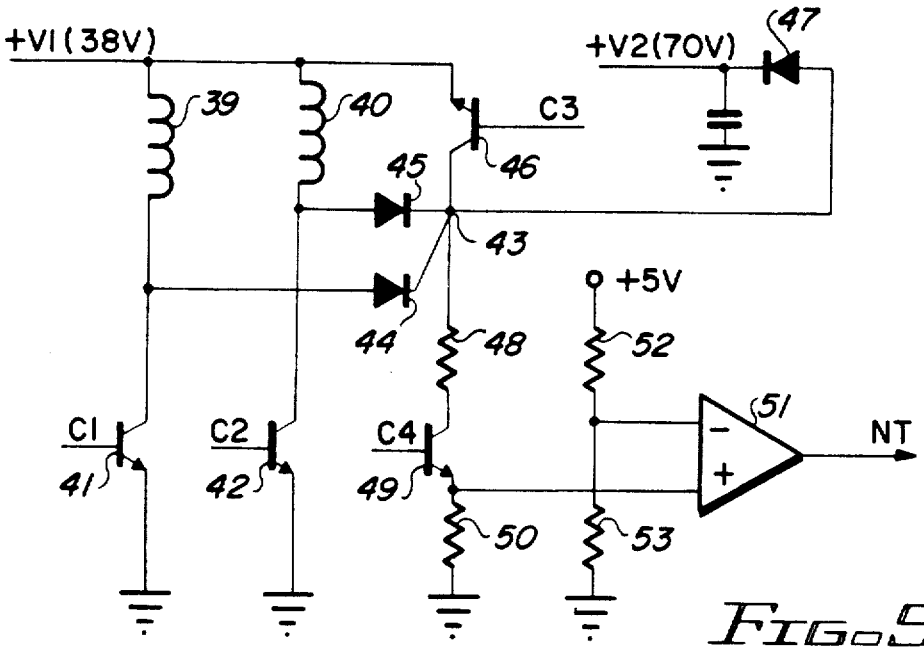
FIG. 5 is a further alternative embodiment of detection circuit for the apparatus of FIG. 1.

FIG. 5 shows an apparatus embodying this concept.

In FIG. 5, two windings 38, 39 are shown each one for actuation of a printing element (in practice the printing elements may be in number of 7, 9, 18, 24). The two windings 38, 39 are connected to a powering voltage source +V1, for instance 38V, and to ground, each through a transistor switch 41, 42 respectively.

The two transistors, having grounded emitter, are respectively controlled by commands C1, C2 input to their base.

The collector of transistors 41, 42 is connected to a common node 43, through diodes 44, 45 respectively. The diodes are conductive in the direction from collector to common node.

Node 43 is connected through a transistor switch 46 to voltage source +V1. It is further connected, through a diode 47, to a voltage source +V2 higher than +V1. +V2 may be in the range of 70 V.

Transistor 46 is controlled by a signal C3 input to its base.

This driving circuit may be considered as a "standard" for printing heads, even if several changes can be made to the arrangement.

The closing of switches 41, 42 causes a fast energization of windings 39, 40. The current flowing in the windings is sustained, when switches 41, 42 are closed, by the recycle path provided by diodes 44, 45 and transistor switch 46 which is kept closed for a suitable duration.

When switch 46 is open, the windings demagnetize rapidly by discharging their energy to the voltage source +V2, through diode 47.

According to the invention the node 43 is connected, through a resistor 48, to the collector of a transistor 49.

Transistor 49 has the emitter connected to ground, through a measuring resistor 50 and to the non inverting input of a comparator 51.

The comparator 51 receives a reference voltage VR at the inverting input.

VR is obtained from a voltage divider comprising two resistors 52, 53 series connected between a voltage source +5V and ground.

Figure 6:
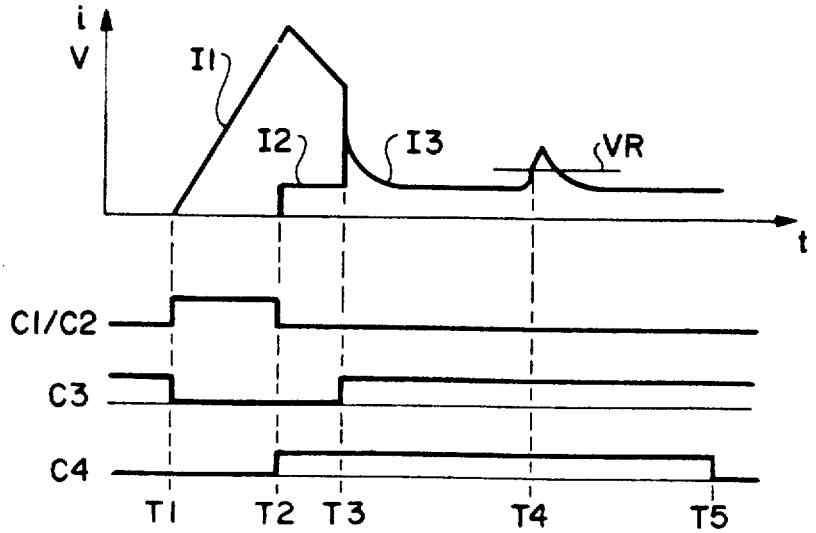
FIG. 6 shows in timing diagram the signal levels at selected points of the circuit of FIG. 5.

FIG. 6 shows in timing diagram the operation of the circuits of FIG. 5.

At a time T1 the windings 39, 40 are energized as if a normal printing operation has to be performed and the energizing current rises until commands C1, C2 are deasserted (time T2, diagrams 11, C1/C2).

Transistor 46 is kept conductive (diagram C3) and transistor 49 is closed (diagram C4). Therefore the current in the windings is sustained and decreases slowly.

A portion of the current flowing in the windings is diverted and flows through transistor 49 and resistor 50 (diagram 12) producing a corresponding voltage drop in resistor 50.

At time T3 the opening of transistor 46 causes a fast demagnetization of windings 39, 40 with a significant increase in the induced e.m.f., which brings node 43 at the level of voltage source +V2 and causes a current (and voltage) spike at the emitter of transistor 49 (diagram 13).

Then the emitter current of transistor 49 stabilizes at a level (14) limited by the internal resistance of the windings and by resistors 48, 50 series connected.

The voltage drop in resistor 50 related to such current is lesser than reference voltage VR input to comparator 51.

With the energization of windings 39, 40 the related electromagnets are cocked.

They are held cocked by command C4.

Clearly this operation must be performed when the print head is far from the printing support, so as to avoid the printing of dots.

Further, as in the previously described embodiments, the interrupt signal in output from comparator 51 is masked.

Once the electromagnets are cocked, the interrupt signal in output from comparator 51 is enabled and the microprocessor controls the advancement of the print head towards the printing support.

When the printing elements of the print head interfere with the printing support (time T4) the armatures of the electromagnets are released and a voltage spike is induced which is detected by the comparator and signaled to the microprocessor.

At this point, the microprocessor may stop the print head movement or control a further forward/backward movement for a predetermined amount so as to place the print head at the distance required for the printing operation.

It further controls (time T5), the opening of transistor 49 so that the normal operation of the printing electromagnets 39, 40 is not modified in the course of the subsequent printing operation.

In the preceding description reference has been made to motor means which control the movement of the printing head, relative to the platen.

It is however, clear that the motor means may act on the position of the platen, hence of the printing media, with the identical result of modifying the gap between print head and platen.

What is claimed is:

1. Apparatus for automatically adjusting the gap between a printing head and a printing medium of the kind in which motor means enable changing the distance of the printing head from the printing support, a sensor fixed to the printing head provides a signal indicating the distance of the printing head from the printing support and a control logic controls said motor means as a function of said signal, characterized in that:

said sensor comprises an electromagnet having a movable armature/plunger resiliently biased away from the printing support and a fixed energizing winding, and in that said control logic comprises:

means for energizing said electromagnet with a dc current cocking said armature/plunger against the resilient bias at a position at which the print head is suitably spaced from the printing support, means for powering said electromagnet with a holding dc current sufficient to hold the armature/-plunger cocked, motor means for causing relative movement of the printing head towards the printing support thereby causing the armature/plunger to mechanically engage the printing support, and means for detecting the reluctance change in the magnetic circuit of said electromagnet which from said mechanical engagement of said armature/-plunger with said printing support due to said relative movement of the printing head towards the printing support.

2. Apparatus as in claim 1 wherein said sensor comprises at least one electromagnet for actuation of a printing element of said print head.

* * * * *